US008188358B2

(12) United States Patent
Peck

(10) Patent No.: US 8,188,358 B2
(45) Date of Patent: May 29, 2012

(54) PERCUSSION INSTRUMENT

(75) Inventor: David R. Peck, Copley, OH (US)

(73) Assignee: David R. Peck, Copley, OH (US)

( * ) Notice: Subject to any disclaimer, the term of this patent is extended or adjusted under 35 U.S.C. 154(b) by 100 days.

(21) Appl. No.: 12/871,382

(22) Filed: Aug. 30, 2010

(65) Prior Publication Data

US 2012/0048098 A1 Mar. 1, 2012

(51) Int. Cl.
*G10H 3/16* (2006.01)

(52) U.S. Cl. ..... 84/732

(58) Field of Classification Search ..... 84/732
See application file for complete search history.

(56) References Cited

U.S. PATENT DOCUMENTS 5,293,000 A * 3/1994 Adinolfi ..... 84/730
2010/0105326 A1* 4/2010 Hsien ..... 455/41.2

* cited by examiner

*Primary Examiner* — Jianchun Qin
(74) *Attorney, Agent, or Firm* — Fay Sharpe LLP; Brian E. Turung

(57) ABSTRACT

A percussion instrument that is formed of a housing, a compressible foam material connected to the housing, an electronic pick-up embedded within said compressible foam material and a compression plate. The housing includes a front opening and a cavity and a rear portion of the compressible foam material extends through the front opening of the housing and into the cavity of the housing. The electronic pick-up is spaced from the outer surface of the compressible foam material. The compression plate is positioned on the front face of the compressible foam material and is spaced from an outer edge of the front face.

20 Claims, 6 Drawing Sheets

PERCUSSION INSTRUMENT

The present invention is directed to percussion instruments, more particularly to electronic percussion instruments, and even more particularly to electronic percussion instruments that include a piezoelectric device.

BACKGROUND OF THE INVENTION

Electronic music instruments have continued to gain popularity due to the diverse sounds that can be produced from such instruments. As such, many types of modern music use electric or electronic instruments as a substitute for, or as a complement to traditional acoustic instruments. Such electric or electronic instruments include electric guitars and electronic keyboards. Electronic percussion instruments have also been developed to electronically simulate one or more traditional drums or a complete drum set. Various types of electronic drums are illustrated in U.S. Pat. Nos. 7,446,254; 4,753,146; and 2,655,071, all of which are incorporated herein by reference.

In view of the prior art, there remains a need for an electronic percussion instrument that can be easily and conveniently played by hand and/or by another type of striking implement, and which can be easily and conveniently incorporated into a drum set or the like.

SUMMARY OF THE INVENTION

The present invention is directed to an electronic percussion instrument that can be used as a complement instrument to a conventional set, or can be used as a substitute for one or more traditional percussion instruments. The electronic percussion instrument includes a durable housing, a compressible foam material connected to the housing and an electronic pick-up embedded within the compressible foam material. The durable housing can be formed of any type of durable material (e.g., metal, wood, plastic, ceramic, fiberglass, composite materials, etc.). The shape of the durable housing is non limiting. The compressible foam material is selected to be struck by a hand, drum stick, mallet, etc. to cause the electronic pick-up within the foam material to generate a signal that corresponds to the foam material being struck. The signal from the electronic pick-up can be sent to an electronic processor to generate a desired sound (e.g., snare drum sound, bass drum sound, steel drum, bongo drum sound, tambourine sound, cymbal sound, cow bell sound, gong sound, etc.).

In one non-limiting aspect of the present invention, the compressible foam material is designed to be a durable material that can withstand repeated strikes by a hand, drum stick and the like without being permanently deformed. The compressible foam material is also designed to slightly compress when the compressible foam material is struck, and to thereafter return to its original shape. The compressible feature of the compressible foam material has two primary functions, namely, 1) functions as a cushion for a player's hand(s) when striking the foam material so as to not bruise the player's hand(s) and enabling the player to repeatedly strike the foam material over a long period of time, and 2) facilitate in damping the sound caused by the foam being struck. Hard plastic and hard rubber surfaced electronic drums are currently available. The hard plastic and hard rubber surfaced electronic drums are designed to be struck by a drum stick or other object. However, the hard surface of these prior art drums does not make such drums conducive to extensive playing by a hand since repeated bare hand playing on such a surface is painful over time. The compressible foam material used in the percussion instrument of the present invention overcomes this problem associated with prior art electronic drums. Another problem associated with hard plastic and hard rubber surfaced electronic drums is that when such a surface is struck, an audible sound is generated. This sound may be undesirable to hear in combination with the electron sound being generated by the electronic drum. The compressible foam material used in the percussion instrument of the present invention also overcomes this problem associated with prior art electronic drums. In one non-limiting embodiment of the invention, the density if the compressible foam material is about 1.2-6 lbs/ft$^3$ (ASTM D3575-08), a compressive strength of about 5-28 psi (Vertical @ 25%—ASTM D3575-08 Suffix D) and a tear resistance of at least about 8 lbs/in across the gain @ 0.5 in. thickness (ASTM D3575-08 Suffix G). It has been found that when the compressible foam material has a density of less than 1.2 lbs/ft$^3$ and a compressive strength of less than 5 psi, the compressible foam material is 1) too soft and can result in the non-activation of the electronic pick-up that is embedded in the compressible foam material and 2) is too deformable, thus will not reform into its original shape after repeated strikes by a player's hands and/or other types of striking implements (e.g., drum stick, etc.). Also, when the tear resistance of the compressible foam material is less than 8 lbs/in, the compressible foam material is very susceptible to damage from repeated strikes by a player's hands and/or other types of striking implements. It has also been found that when the compressible foam material has a density of greater than 6 lbs/ft$^3$ and a compressive strength of greater than 28 psi, the compressible foam material is 1) too hard and can result in the multiple incidences of activation of the electronic pick-up by a single strike, 2) creates a loud sound when struck, thus creating an undesired sound when played, and 3) can be uncomfortable to play with bare hands for extended periods of time. A tear resistance of less than 8 lbs/in across the grain @ 0.5 in. will result in premature damage to the compressible foam material from repeated strikes by a player's hands and/or other types of striking implements. In one non-limiting aspect of this embodiment, the compressible foam material has a density of about 1.3-4 lbs/ft$^3$ and a compressive strength of about 6-20 psi, and a tear resistance of at least 9 lbs/in across the grain @ 0.5 in. In another non-limiting aspect of this embodiment, the compressible foam material has a density of about 1.5-3 lbs/ft$^3$ and a compressive strength of about 6-16 psi, and a tear resistance of at least 9 lbs/in across the grain @ 0.5 in. In still another non-limiting aspect of this embodiment, the compressible foam material has density of about 1.6-2.5 lbs/ft$^3$ and a compressive strength of about 7-15 psi, and a tear resistance of at least 9 lbs/in across the grain @ 0.5 in. In still another and/or alternative non-limiting embodiment of the invention, the compressible foam material is or includes polyethylene foam, polyether polyurethane foam, and/or polyurethane foam. In one non-limiting formulation, the compressible foam material includes over 50 weight percent polyethylene foam. In another non-limiting formulation, the compressible foam material includes at least about 75 weight percent polyethylene foam. In still another non-limiting formulation, the compressible foam material includes at least about 90 weight percent polyethylene foam. In yet another non-limiting formulation, the compressible foam material includes about 100 weight percent polyethylene foam.

In another and/or alternative non-limiting aspect of the present invention, the compressible foam material has a sufficient thickness and surface area to enable a player to conveniently and easily strike the surface of the compressible foam material and to also inhibit or prevent damage to the electronic pick-up embedded within the compressible foam material. In one non-limiting embodiment of the invention, the electronic pick-up is positioned at least 0.25 inches below all of the outer surfaces of the compressible foam material. In another non-limiting embodiment of the invention, the electronic pick-up is positioned up to about 2 inches below all of the outer surfaces of the compressible foam material. It has been found that when the electronic pick-up is positioned less than 0.25 inches below the Outer surface of the compressible foam material, the electronic pick-up can be damaged when the outer surface of the compressible foam material is struck. In addition, when the electronic pick-up is positioned less than 0.25 inches below the outer surface of the compressible foam material, the electronic pick-up may generate or trigger multiple signals when the outer surface of the compressible foam material is only struck once, thus producing undesired repeated sounds. It has also be found that when the electronic pick-up is positioned over 2 inches below the outer surface of the compressible foam material, the electronic pick-up may not consistently generate or trigger a signal when the outer surface of the compressible foam material is struck. In one non-limiting configuration, the electronic pick-up is positioned about 0.3-1.75 inches below the outer surface of the compressible foam material. In another non-limiting configuration, the electronic pick-up is positioned about 0.5-1.5 inches below the outer surface of the compressible foam material. In another and/or alternative embodiment of the invention, the top surface of the compressible foam material has a sufficient surface area to enable a player to strike the top surface with the player's hand and/or some type of striking implement (e.g., drum stick, mallet, etc.). In one non-limiting configuration, the top surface of the compressible foam material has a strikable surface area of at least about 10 in.$^2$. As defined herein, "strikable surface area" is defined as a surface area on the compressible foam material that can be directly struck by a player's hand and/or some type of striking implement. The surface area of the compressible foam material that cannot be directly struck (e.g., a portion of the compressible foam material that is covered by the durable housing, etc.) is not part of the "strikable surface area". In another non-limiting configuration, the top surface of the compressible foam material has a strikable surface area of about 10-150 in.$^2$. In still another non-limiting configuration, the top surface of the compressible foam material has a strikable surface area of about 12-75 in.$^2$. In yet another non-limiting configuration, the top surface of the compressible foam material has a strikable surface area of about 12-50 in.$^2$. In yet another non-limiting configuration, the top surface of the compressible foam material has a strikable surface area of about 15-30 in.$^2$. In still another and/or alternative embodiment of the invention, the top surface and the bottom surface of the compressible foam material have a sufficient surface area to enable a player to strike the top and bottom surfaces with the player's hand and/or some type of striking implement. In one non-limiting configuration, the top surface and bottom surface of the compressible foam material have the same shape and surface area size. In another non-limiting configuration, the top surface and bottom surface of the compressible foam material have a different shape and/or surface area size. In yet another and/or alternative embodiment of the invention, the compressible foam material has a top surface, a bottom surface, and one or more side surfaces, each of which have a sufficient surface area to enable a player to strike the top, bottom and at least one side surfaces with the player's hand and/or some type of striking implement. In one non-limiting configuration, the top surface, bottom surface, and one or more side surfaces of the compressible foam material have the same shape and surface area size. In another non-limiting configuration, the top surface, bottom surface, and one or more side surfaces of the compressible foam material have a different shape and/or surface area size. In still another non-limiting configuration, the top surface and bottom surface of the compressible foam material have the same shape and surface area size, and the one or more side surfaces of the compressible foam material have a different shape and/or surface area size from the top surface and bottom surface. In yet another non-limiting configuration, the strikable top surface and bottom surfaces have i) a generally rectangular shape with a length of about 3-10 inches and a width of about 2-6 inches, ii) two generally rectangular shaped strikable side surfaces and a generally rectangular strikable front surface, wherein the side and front surfaces have a thickness of about 1.5-4 inches and the side surfaces have a length that is generally the same as the length of the top surface and bottom surface and each side has a strikable surface area, and iii) the compressible foam material has a strikable surface area of about 15-120 in.$^2$. In still yet another non-limiting configuration, the top surface and bottom surface have a generally half moon shape, and at least one side surface having a thickness of about 1.5-4 inches and a strikable surface area, and the compressible foam material has a strikable surface area of about 15-160 in.$^2$.

In still another and/or alternative non-limiting aspect of the present invention, the foam material includes a flexible protective coating on one or more outer surfaces of the compressible foam material. The flexible protective coating is designed to a) increase the longevity of the compressible foam material, and b) facilitate in the ease of cleaning the outer surface of the compressible foam material. In one non-limiting embodiment of the invention, the flexible protective coating has a coating thickness of at least about 0.0005 inches and less than about 0.5 inches. In one non-limiting configuration, the flexible protective coating has a coating thickness of at least about 0.001-0.1 inches. In still another non-limiting configuration, the flexible protective coating has a coating thickness of at least about 0.001-0.05 inches. In another non-limiting embodiment of the invention, the flexible protective coating is applied to one or more of the strikable surface areas of the compressible foam material. In one non-limiting configuration, the flexible protective coating is applied to all of the strikable surface areas of the compressible foam material. In still another non-limiting embodiment of the invention, the flexible protective coating includes a silicone and/or rubber material. In one non-limiting configuration, the flexible protective coating includes EPDM rubber (Ethylene Propylene Dimonomer).

In yet another and/or alternative non-limiting aspect of the present invention, the electronic pick-up is embedded within the compressible foam material which includes a piezoelectric device. One or more electronic pick-ups can be embedded within the compressible foam material. When two or more electronic pick-ups are embedded within the compressible foam material, the types of electronic pick-ups can be the same or different. In one non-limiting arrangement, only a single electronic pick-up is embedded within the compressible foam material. When the electronic pick-up is a piezoelectric device, the type of piezoelectric device is non-limiting.

In still yet another and/or alternative non-limiting aspect of the present invention, the electronic pick-up is embedded within the compressible foam material which includes a friction layer on one or more outer surfaces of the electronic pick-up. The one or more friction layers are designed to frictionally engage an interior surface of the compressible foam material and limit or prevent movement of the electronic pick-up within the compressible foam material when the outer surface of the compressible foam material is repeatedly struck. In one non-limiting arrangement, one or more thin layers of foam material are connected (e.g., adhesive, melted bond, clamp, etc.) to one or more outer surfaces of the electronic pick-up prior to the electronic pick-up being inserted into the interior of the compressible foam material. The material connected to the electronic pick-up can be the same as or different from the compressible foam material. In one non-limiting configuration, a foam material that has the same or similar composition as the compressible foam material is adhesively secured to the top and/or bottom sides of each electronic pick-up that is positioned in the interior of the compressible foam material. The thickness of the layer of foam material is generally less than about 1 inch, typically less than about 0.5 inches, and more typically less than about 0.25 inches.

In another and/or alternative non-limiting aspect of the present invention, the compressible foam material includes a slot formed and/or cut in the front end, back end and/or one or more sides of the compressible foam material. The slot is designed to enable the one or more electronic pick-ups to be inserted into the interior of the compressible foam material. The slot can also or alternatively be used to enable one or more electric cables connected to the one or more electronic pick-ups to extend from the one or more electronic pick-ups located in the interior of the compressible foam material to an exterior portion of the compressible foam material so that such electric cables can be connected to a plug or other type of electrical connector located on the durable housing or other portion of the electronic percussion instrument. On one non-limiting configuration, the compressible foam material includes at least one slot in the front side of the compressible foam material and extends through the body of the compressible foam material and to a slot opening in the back side of the compressible foam material.

In another and/or alternative non-limiting aspect of the present invention, the compressible foam material includes one or more mount holes that are each designed to receive a mount element (e.g., bolt, screw, nail, rod, etc.). In one non-limiting embodiment of the invention, one or more of the mount elements can have a coating and/or covering that is designed to frictionally engage the compressible foam material and/or maintain the compressible foam material in position relative to the one or more mount elements; however, this is not required. In one non-limiting aspect of this embodiment, a tube (e.g., plastic tube, etc.) is provided wherein a mount element is inserted through the tube and the tube and the mount element are inserted into a mount hole in the compressible foam material. The tube can have an inner diameter opening that is the same as or greater than the outer diameter of the mount element; however, this is not required. In one non-limiting arrangement, at least a portion of the mount element that is positioned in the tube has a cross-sectional area that is at least about 0.1% less than the cross-sectional area of the inner cross-sectional area of the tube. In another non-limiting arrangement, at least a portion of the mount element that is positioned in the tube has a cross-sectional area that is no more than about 75% less than the cross-sectional area of the inner cross-sectional area of the tube. In still another non-limiting arrangement, at least a portion of the mount element that is positioned in the tube has a cross-sectional area that is about 0.1%-50% less than the cross-sectional area of the inner cross-sectional area of the tube. In yet another non-limiting arrangement, at least a portion of the mount element that is positioned in the tube has a cross-sectional area that is about 0.1%-25% less than the cross-sectional area of the inner cross-sectional area of the tube. In still yet another non-limiting arrangement, at least a portion of the mount element that is positioned in the tube has a cross-sectional area that is about 0.1%-10% less than the cross-sectional area of the inner cross-sectional area of the tube. In another and/or alternative non-limiting embodiment of the invention, the tube has a longitudinal length that is less than the longitudinal length of the compressible foam material. In one non-limiting arrangement, the tube has a longitudinal length that is at least about 1% less than the longitudinal length of the compressible foam material. In another non-limiting arrangement, the tube has a longitudinal length that is no more than about 50% less than the longitudinal length of the compressible foam material. In still another non-limiting arrangement, the tube has a longitudinal length that is about 1%-25% less than the longitudinal length of the compressible foam material. In yet another non-limiting arrangement, the tube has a longitudinal length that is about 2%-15% less than the longitudinal length of the compressible foam material. In still yet another non-limiting arrangement, the tube has a longitudinal length that is about 2%-10% less than the longitudinal length of the compressible foam material. In yet another and/or alternative non-limiting embodiment of the invention, a compression bar can be used to at least partially maintain the compressible foam material on the durable housing. The one or more mount elements can be used to secure the compression bar to the compressible foam material. In one non-limiting aspect of this embodiment, the compression bar is positioned on the front face of the compressible foam material and the one or more mount elements secure the compression bar on the front face of the compressible foam material. The compression bar can be used to partially or fully cover a slot opening that can exist on the front face of the compressible foam material; however, this is not required. In another non-limiting aspect of this embodiment, the compression bar is sized and positioned on the front face of the compressible foam material so that the compression bar is spaced from the outer edges of the front face. Such spacing of the compression bar is spaced from the outer edges of the front face resulting in limited or no contact by a player's hand or a striking implement with the compression bar when the top, bottom and one or more side surfaces (not including the front face) of the compressible foam material is struck. Generally, the compression bar is positioned at least about 0.1 inches from the outer edges of the front face, typically at least about 0.2 inches from the outer edges of the front face, more typically at least about 0.25 inches from the outer edges of the front face, and even more typically at least about 0.5 inches from the outer edges of the front face. The spacing of the compression bar from each of the outer edges of the front face can be the same or different. In one non-limiting arrangement, the compression bar is spaced closer to the side edges of the compressible foam material than to the top edges of the compressible foam material.

In another and/or alternative non-limiting aspect of the present invention, one or more mounting brackets can be included on the durable housing. The mounting bracket can be used to secure the durable housing to a standard cymbal stand or the like. An expansion bracket can be provided to secure two electronic percussion instruments to be connected together side-by-side so that the two electronic percussion instruments can be mounted to a single standard cymbal stand or the like; however, this is not required.

It is an object of the invention to provide an improved electronic percussion instrument which overcomes these and other drawbacks of the prior art.

It is another object of the invention to provide an improved electronic percussion instrument which can be easily and conveniently played by hand and/or with a striking implement.

It is a still another object of the invention to provide an improved electronic percussion instrument which can be easily and conveniently incorporated into an existing drum system.

These and other advantages will become apparent to those skilled in the art upon the reading and following of his description taken together with the accompanying drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE INVENTION

Figure 3:
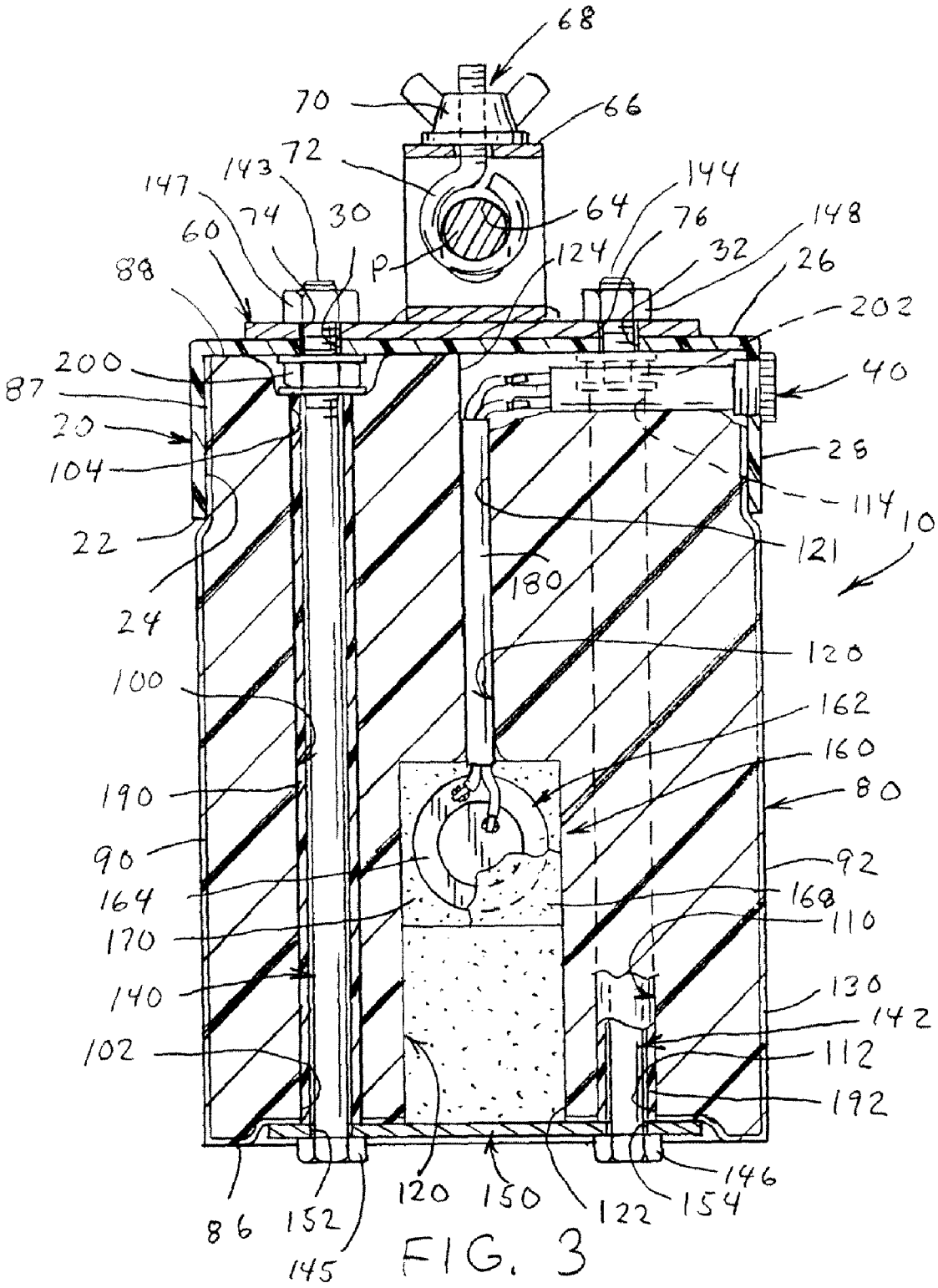
FIG. 3 is a partial cross-sectional view of the percussion instrument of FIG. 1 along the longitudinal length of the percussion instrument.
Figure 4:
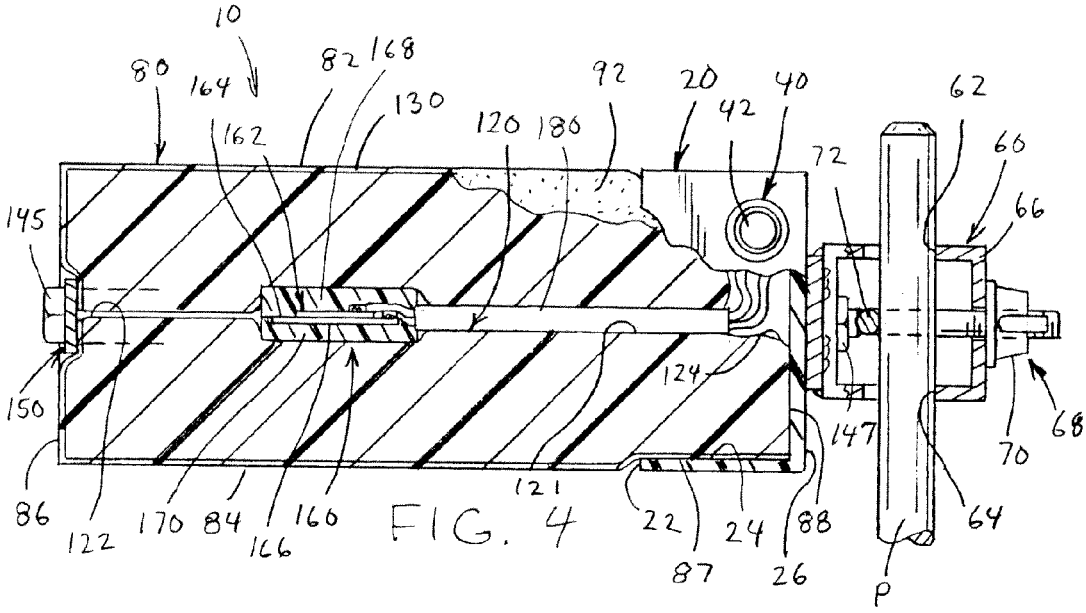
FIG. 4. is a partial cross-sectional view of the percussion instrument of FIG. 1 along the lateral length of the percussion instrument.
Figure 5:
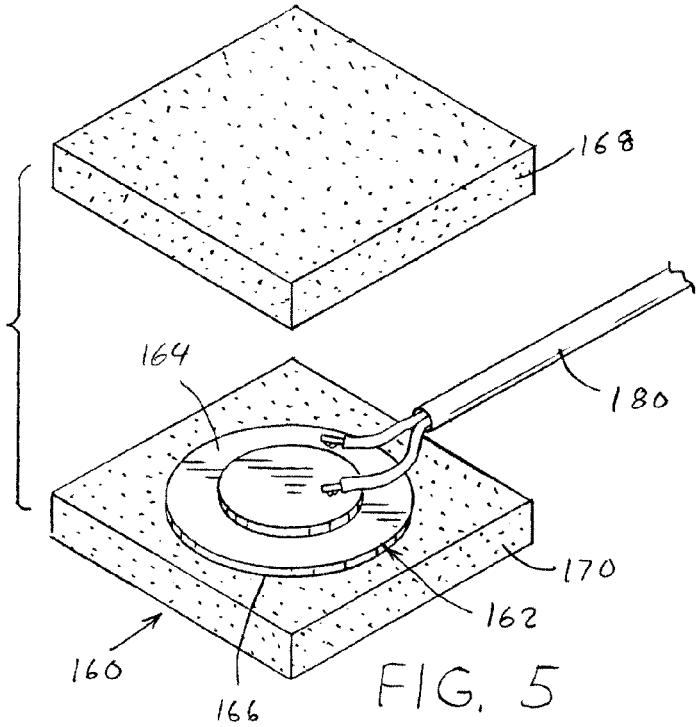
FIG. 5 is an enlarged view of the electronic pick-up of the percussion instrument of FIG. 1.

Referring now to the drawings wherein the showing is for the purpose of illustrating preferred embodiments of the invention only and not for the purpose of limiting the same, FIGS. 1-5 illustrate an electronic percussion instrument in accordance with the present invention. The electronic percussion instrument 10 includes a durable housing 20, a compressible foam material 80, and an electronic pick-up 160. The durable housing 20 is generally formed of a rigid, non-compressible material such as, but not limited to hard plastic, metal, wood, ceramic, composite materials and the like. The front 22 of the durable housing 20 includes a cavity 24. The cavity is illustrated as also having a generally rectangular cross-sectional shape; however, this is not required. Cavity 24 is designed to telescopically receive a back portion 87 of the compressible foam material 80. The back portion 87 can be frictionally inserted into the cavity and/or adhesively connected in the cavity; however, this is not required. As illustrated in FIG. 5, the back portion 87 of the back portion 87 is in a slightly compressed state when positioned in cavity 24. A mounting bracket 60 is connected to the back face 26 of the durable housing 20. The mounting bracket is used to secure the electronic percussion instrument 10 to a stand pole P or other type of support device. The mounting bracket includes two openings 62, 64 in a flange 66. The openings are designed to receive stand pole P. The mounting bracket also includes a lock arrangement 68 that is used to secure the mounting bracket on a certain position on the stand pole. The lock arrangement includes a wing nut 70 and an eye-bolt 72. The wing nut is used to create and release frictional engagement of the eye-bolt with a portion of the stand pole that is inserted through the eye-bolt so that the percussion instrument can be positioned on the stand pole and removed from the stand pole.

The back face 26 of the durable housing 20 includes two bolt openings 30, 32. The two bolt openings can be used to secure mounting bracket 60 to the back face 26 of the durable housing 20. As illustrated in FIG. 3, the mounting bracket includes two mount openings 74, 76 that are designed to match-up with openings 30, 32 so that a bolt, screw or the like can be used to secure the mount bracket to the durable housing. As can be appreciated, the mounting bracket can be secured to the durable housing by other or additional means (e.g., adhesive, melt bonding, solder, weld, etc.).

Figure 1:
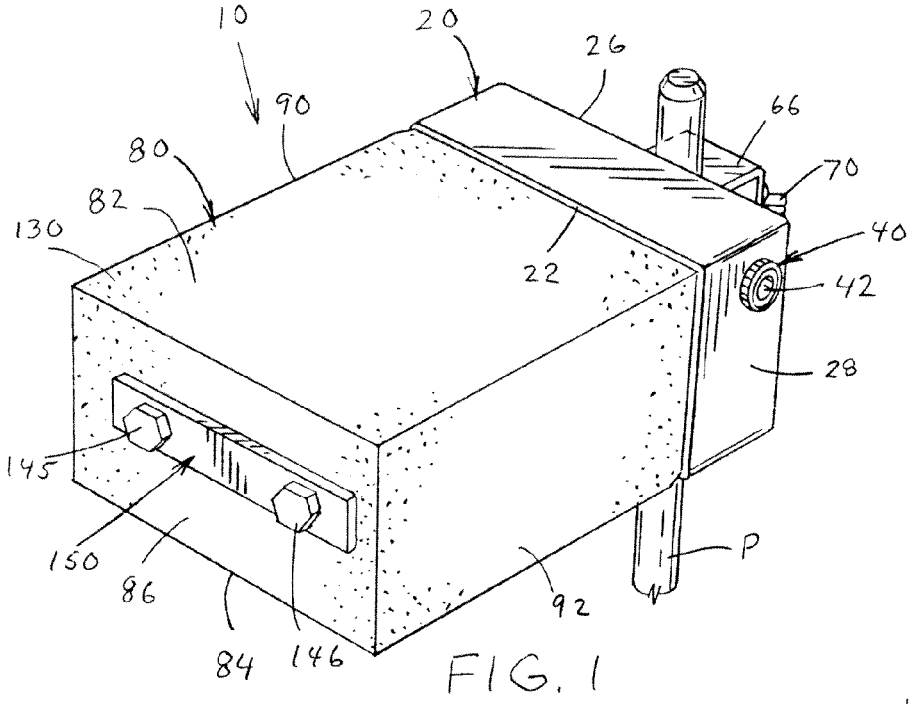
FIG. 1 is a front elevation view of the percussion instrument in accordance with the present invention.
Figure 2:
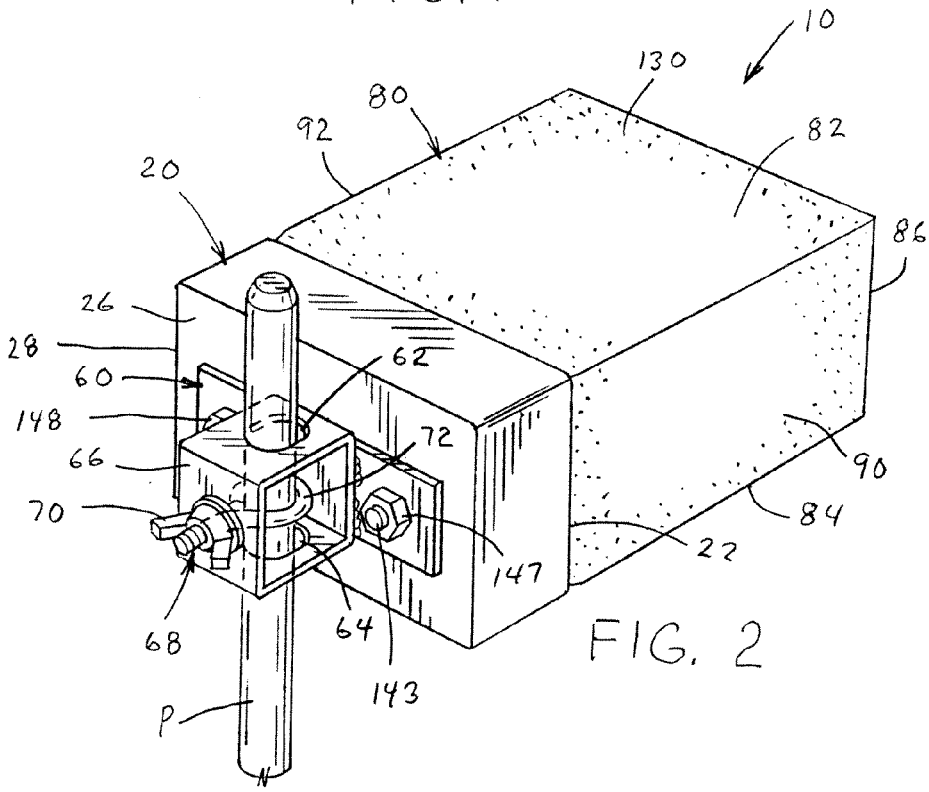
FIG. 2 is a back elevation view of the percussion instrument of FIG. 1.

The durable housing includes one or more audio jacks 40. The opening 42 in the audio jack is designed to enable an audio cable, not shown, to be plugged into the audio jack so that signals generated by one or more electronic pick-up 160 in the compressible foam material 80 can be received by one or more signal processors (e.g., synthesizer, etc.), not shown, to generate a desired sound when the striking surface of the compressible foam material 80 is struck. The location of the one or more audio jacks 40 on the durable housing is not limited. As illustrated in FIGS. 1, 3 and 4, the opening 42 in the audio jack is positioned on one side 28 of the durable housing. As can be appreciated, the durable housing can include more than one audio jack opening (e.g., one audio jack opening on both sides of durable housing, etc.).

The compressible foam material 80 is illustrated as a generally rectangular block of material having a top surface 82, a bottom surface 84, a front face 86, a back face 88, and two side surfaces 90, 92. As can be appreciated, the compressible foam material can have other configurations. As set forth above, the back region 87 of the compressible foam material 80 is designed to be inserted into the cavity of the durable housing. Generally, at least a portion of the back face 88 of the compressible foam material engages the interior back surface of cavity 24 when the compressible foam material 80 is fully inserted into the durable housing as illustrated in FIGS. 3 and 4; however, this is not required. The back portion of the compressible foam material generally has the same cross-sectional shape and generally has the same or greater size as cavity 24 so that the compressible foam material snugly or frictionally fits within the cavity; however, this is not required.

As illustrated in FIGS. 1-4, a majority of the outer surface of the compressible foam material is not inserted into cavity 24. As can be appreciated, the strikable surface of the compressible foam material is the outer surface of the compressible foam material that is not inserted in cavity 24. Generally, less than about 40 percent of the outer surface of the compressible foam material is inserted into cavity 24, typically less than about 30 percent of the outer surface of the compressible foam material is inserted into cavity 24, more typically about 5-30 percent of the outer surface of the compressible foam material is inserted into cavity 24, even more typically about 5-20 percent of the outer surface of the compressible foam material is inserted into cavity 24, and still even more typically, about 8-25 percent of the outer surface of the compressible foam material is inserted into cavity 24.

The compressible foam material is designed to be a durable material that can withstand repeated strikes by a hand, drum stick, and the like without being permanently deformed. The compressible foam material is also designed to slightly compress when the compressible foam material is struck, and to thereafter return to its original shape. The compressible foam material is also designed to enable a player to repeatedly strike the compressible foam material with the player's hand (s) without causing bruising on the player's hands. The compressible foam material is also designed to be durable enough to withstand repeated strikes by a drum stick or the like without causing damage to the compressible foam material. Generally, the density if the compressible foam material is about 1.4-3.5 lbs/ft$^3$ (ASTM D3575-08), has a compressive strength of about 6-25 psi (Vertical @ 25%—ASTM D3575-08 Suffix D) and has a tear resistance of at least about 8 lbs/in across the grain @ 0.5 in. thickness (ASTM D3575-08 Suffix G). One non-limiting compressible foam material of the present invention has a density of about 1.7-2.2 lbs/ft$^3$, a compressive strength of about 9-14 psi and has a tear resistance of at least about 10 lbs/in across the grain @ 0.5 in. thickness. The compressible foam material generally includes polyethylene foam, polyether polyurethane foam, and/or polyurethane foam. One non-limiting compressible foam material of the present invention is 100 percent polyethylene foam.

The strikable outer surface of the compressible foam material is generally coated with a flexible protective coating 130. The flexible protective coating is designed to i) increase the longevity and/or durability of the compressible foam material, ii) facilitate in the ease of cleaning the outer surface of the compressible foam material and/or iii) make the striking surface less abrasive to a player's hands when repeatedly striking the outer surface of the compressible foam material. Generally, the flexible protective coating is a thin coating having a coating thickness of about 0.0008-0.06 inches. In one non-limiting arrangement, the flexible protective coating is a synthetic rubber coating having a coating thickness of about 0.001-0.04 inches.

The size of the housing and compressible foam material are selected so that the compressible foam material can be easily and conveniently struck and that the percussion instrument can be easily placed within the open spaces of a pre-existing drum setup. Generally the total volume of the percussion instrument is about 4 in$^3$ to about 180 in$^3$, and typically about 15-110 in$^3$. As illustrated in FIGS. 1 and 3, percussion instrument is in the general shape of a rectangular prism and has a length of about 4-6 inches, a width of about 3-5 inches, a thickness of about 1.5-3.5 inches, and a volume of about 18-105 in$^3$.

Compressible foam material 80 includes three cut or formed slots 100, 110, 120. Generally slots 100, 110, 120 begin at the front face 86 of the compressible foam material and terminate at the back face 88 of the compressible foam material; however, this is not required. As illustrated in FIGS. 3 and 4, slots 100 and 110 have front slot openings 102, 112 on front face 86 of the compressible foam material and back slot openings 104, 114 on back face 88 of the compressible foam material, respectively. The front and back slot openings are generally circular and are each designed to receive a mount bolt as described below; however, the slots can have other shapes (e.g., polygonal, oval, etc.) and/or be designed to receive other or additional types objects (e.g., screw, wire, tube, etc.). Slot 120 is positioned between slots 100 and 110. Slot 120 also has a front slot opening 122 on front face 86 of the compressible foam material and a back slot opening 124 on back face 88 of the compressible foam material. The shape of front slot opening 122 is illustrated as being different from the shape of back slot opening 124; however, this is not required. Front slot opening 122 of slot 120 is designed to receive electronic pick-up 160 as illustrated in FIGS. 3 and 4. The shape of slot 120 along the longitudinal length of the slot is generally designed to not be uniform so as to limit the distance that the main body 162 of the electronic pick-up 160 can be inserted along the longitudinal length of slot 120. In one non-limiting design, slot 120 is designed to enable the main body of the electronic pick-up to be inserted through front slot opening 122 and about 20-80% of the longitudinal length of slot 120, typically about 25-75% of the longitudinal length of slot 120, and more typically about 30-60% of the longitudinal length of slot 120. The back portion 121 of slot 120 is generally designed to enable an electric cable 180 that is attached to the main body 162 of the electronic pick-up to continue through slot 120 and to exit the back slot opening 124 on back face 88 of the compressible foam material so that the end of the electric cable can be connected to audio jack 40. As illustrated in FIGS. 3 and 4, back slot opening 124 has a generally circular cross-sectional shape and the front slot opening has a generally oval cross-sectional shape. Also, the maximum width of back slot opening 124 and the back portion 121 is less than the maximum width front slot opening 122.

As illustrated in FIG. 5, the main body 162 of electronic pick-up 160 includes two thin layers of compressible material 168, 170 connected to the top and bottom surfaces 164, 166 of the main body 162 of the electronic pick-up. In one non-limiting arrangement, the two thin layers of compressible material 168, 170 are formed of the same material as compressible foam material 80; however, this is not required. The thickness of each of the two thin layers of compressible material is generally less than about 0.5 inches, and typically about 0.05-0.3 inches. The two thin layers of compressible material are generally adhesively connected to the main body 162 of the electronic pick-up prior to the main body 162 of the electronic pick-up being inserted into slot 120. The two thin layers of compressible material are designed to create a frictional engagement with the inside wall surface of slot 120 so that the main body of the electronic pick-up is maintained in a desired position in slot 120 without need for further connection arrangements. In one arrangement, the two thin layers of compressible material are only frictionally engaged with the inside wall surface of slot 120.

The main body 162 of the electronic pick-up generally includes a piezoelectric device that is designed to generate an electrical signal when encountering a certain amount of vibration. The signal strength generated by the piezoelectric device can vary depending on the degree of vibration encountered by the piezoelectric device; however, this is not required. Generally, only one electronic pick-up is inserted into compressible foam material 80. Generally, the piezoelectric device is positioned in the middle region of the compressible foam material. As illustrated in FIGS. 3 and 4, the piezoelectric device is spaced from the outer surfaces of the compressible foam material so that the piezoelectric device is not directly struck when the striking surface of the compressible foam material is struck. Generally the piezoelectric device is spaced about 0.35-1.7 inches from all of the surfaces of the compressible foam material.

Referring now to FIGS. 1, 3 and 4, a compression bar 150 is illustrated as being mounted on the front face 86 of the compressible foam material. The compression bar includes two holes 152, 154 that are designed to line up with front slot openings 102, 112 on front face 86. The ends 143, 144 and bodies of two bolts 140, 142 are designed to be inserted through holes 152, 154, and through slots 100, 110 and through bolt openings 30, 32 of the durable housing. The heads 145, 146 of bolts 140, 142 are designed so as to not fully pass through holes 153, 154 of the compression bar. Ends 143, 144 can optionally have threaded surfaces so that nuts 147, 148 can be threaded on such ends. In this arrangement, back slot openings 104, 114 on back face 88 of the compressible foam material are aligned with bolt openings 30, 32 of the durable housing when the back region of the compressible foam material 80 is inserted into the cavity of the durable housing.

When the compression bar is mounted to the front face of the compressible foam material by bolts 140, 142, the compression bar facilitates in maintaining the compressible foam material in the cavity of the durable housing. As illustrated in FIGS. 3 and 4, bolts 140, 142 are also used to secure mounting brackets to the durable housing. Nuts 147, 148 are tightened sufficiently on the ends of bolts 140, 142 so as to rigidly maintain the mounting bracket on the durable housing. A second set of nuts 200, 202 can be tightened on the ends of bolts 140, 142 so that the tightening of nuts 147, 148 on the ends of bolts 140, 142 does not cause the compression bar to overly compress a portion of the front face of the compressible foam material; however, this is not required. Bolts 140, 142 are illustrated as being thread on nuts 200, 202 so that the compression bar creates a compression force on the front face of the compressible foam material as illustrated in FIGS. 3 and 4; however, this is not required.

As illustrated in FIG. 3, compression bar 150 over lies slot opening 122 of slot 120. The compression bar is sized and positioned on the front face of the compressible foam material so that the compression bar is spaced from the outer edges of the front face of the compressible foam material. Such spacing of the compression bar is designed to limited or prevent contact by a player's hand or a striking implement with the compression bar when the top, bottom and side surfaces (not including the front face) of the compressible foam material is struck. Generally, the compression bar is positioned about 0.3-1.5 inches from the outer edges of the front face.

Referring now to FIGS. 3 and 4, the body of bolts 140, 142 are encircled by flexible tubes 190, 192. The flexible tubes are designed to frictionally engage the compressible foam material and to facilitate in maintaining the compressible foam material in position relative to bolts 140, 142. The inner diameter of tubes 190, 192 is greater than the outer diameter of the body of bolts 140, 142. The length of tubes 190, 192 is less than the length of slots 100, 110 when the compressible foam material is not under longitudinal compression.

Figure 6:
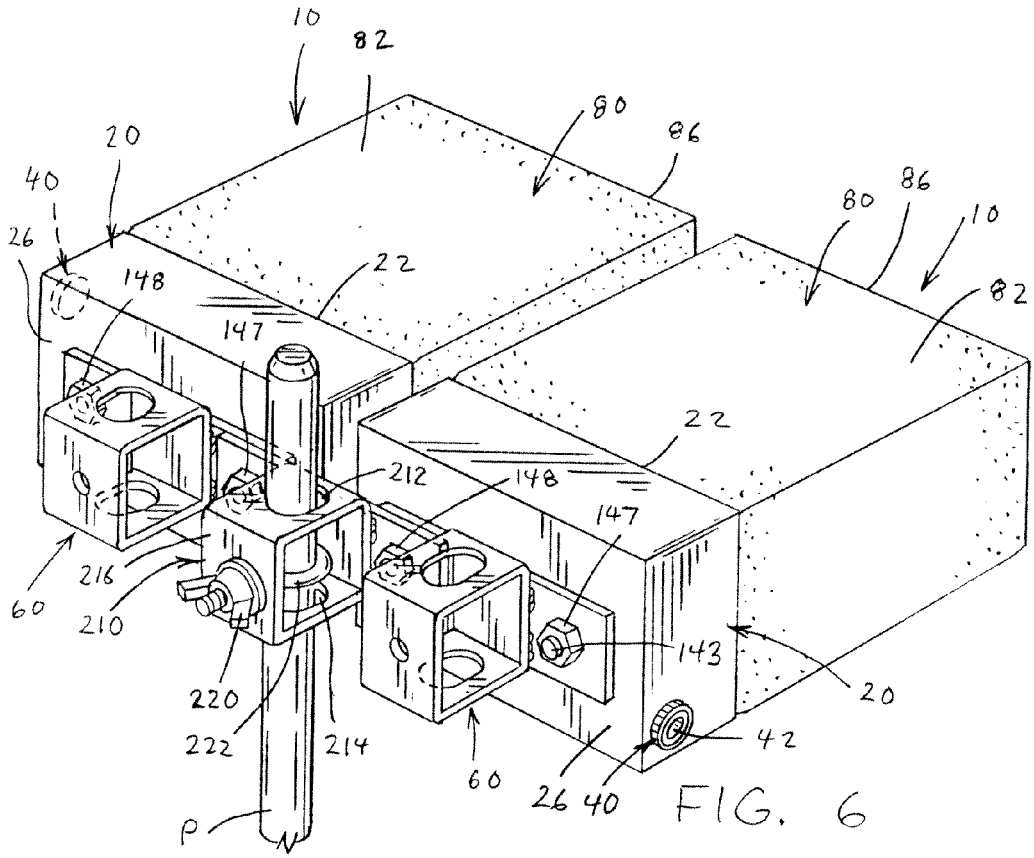
FIG. 6 is a back elevation view of two percussion instruments of FIG. 1 that are mounted together.

Referring now to FIG. 6, two electronic percussion instruments 10 are mounted to a stand pole P. A bracket 210 is connected to the two durable housings 20 of the two electronic percussion instruments 10. The configuration and operation of bracket 210 is very similar to the operation of bracket 60 as described above. Bracket 210 is connected to the back face 26 of the durable housings 20 of the two electronic percussion instruments 10. Mounting bracket 210 includes two openings 212, 214 in a flange 216. The openings are designed to receive stand pole P. Mounting bracket 210 also includes a lock arrangement that is used to secure the mounting bracket on a certain position on the stand pole. The lock arrangement includes a wing nut 220 and an eye-bolt 222. The wing nut is used to create and release frictional engagement of the eye-bolt with a portion of the stand pole that is inserted through the eye-bolt so that the percussion instrument can be positioned on the stand pole and removed from the stand pole. Nut 147 on one percussion instrument and nut 148 on the other percussion instrument are tightened sufficiently on the ends of bolts 140, 142 so as to rigidly maintain mounting bracket 210 on the durable housing.

Figure 7:
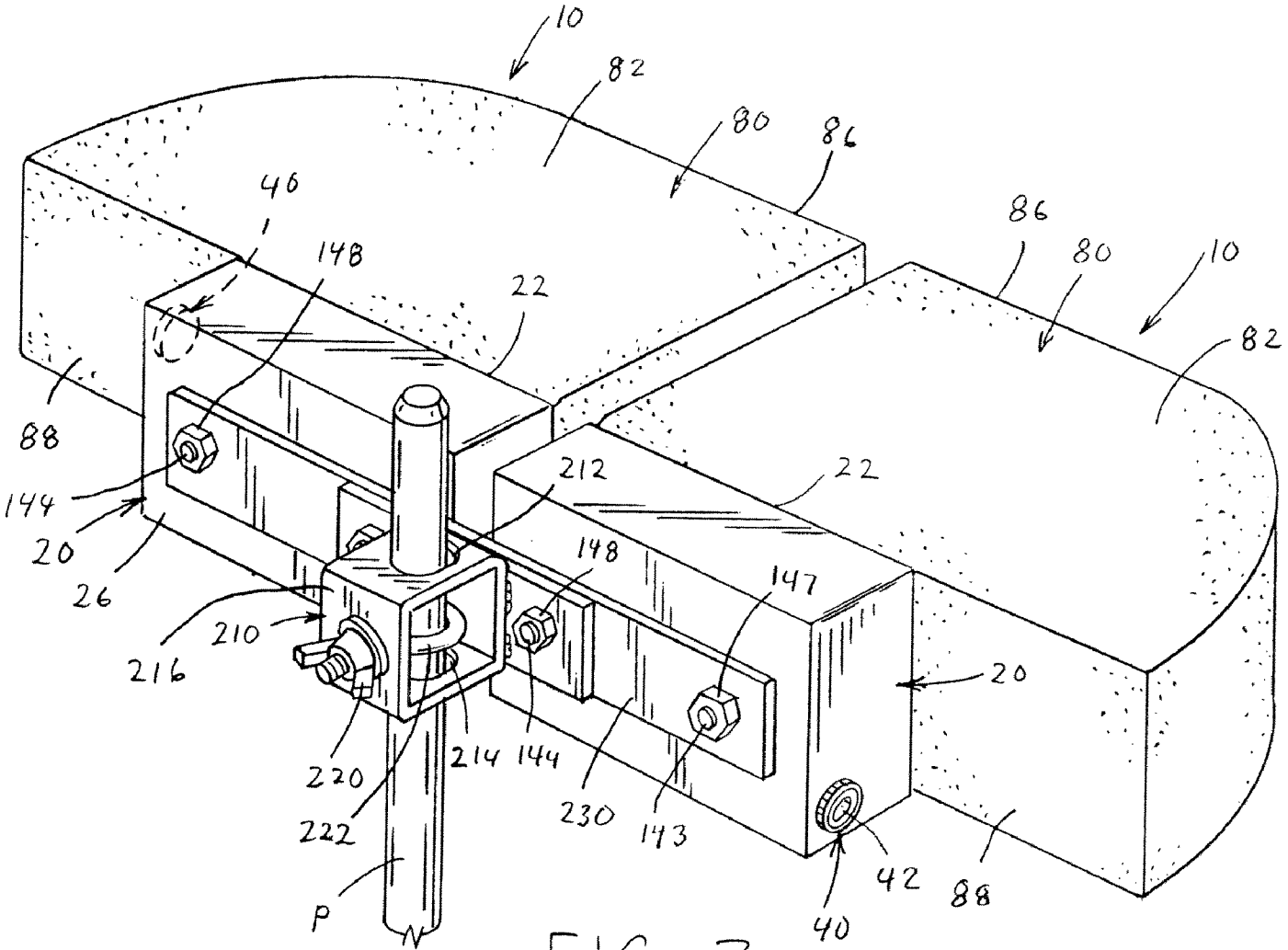
FIG. 7 is a back elevation view of two percussion instruments that are mounted together and have each percussion instrument has a generally quarter circle shape; and, FIG. 8 is a top view of the two percussion instruments of FIG. 7.
Figure 8:
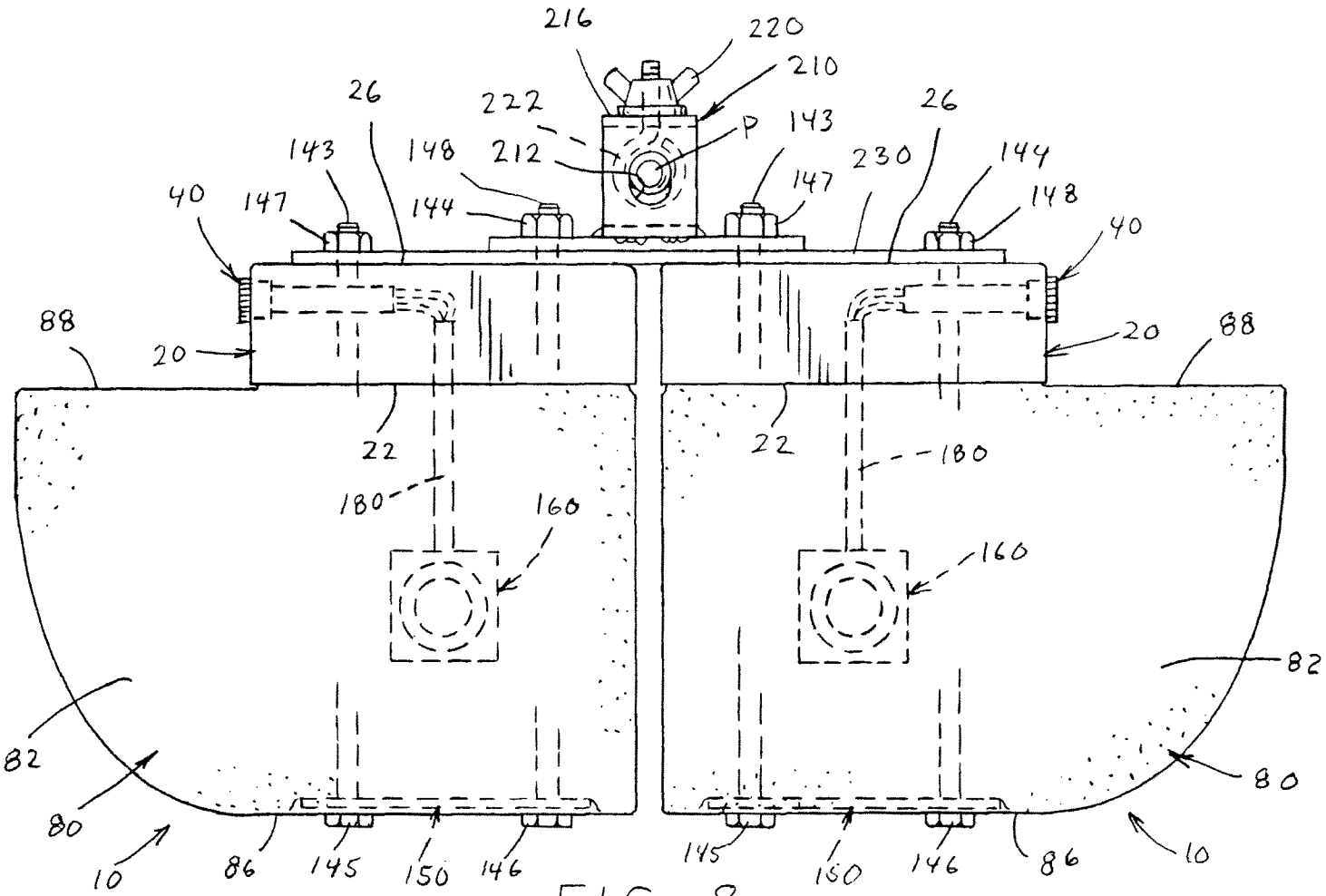

Referring now to FIGS. 7 and 8, there is illustrated a percussion instrument that is very similar to the percussion instrument described above in reference to FIGS. 1-5 except that the shape of the compressible foam material in FIGS. 7 and 8 is different from the shape of the compressible foam material illustrated in FIGS. 1-5. As such, the reference numbers for common components of the percussion instrument are the same. The strikable surface of the compressible foam material illustrated in FIGS. 1-5 is generally a rectangular prism. The strikable surface of the compressible foam material illustrated in FIGS. 7 and 8 is has a top and bottom surface having a shape of a generally a crude quarter circle. The two percussion instrument are connected together by a common plate 230. Mounting bracket 210 is connected to plate 230. As illustrated in FIG. 8, only a portion of the back face 88 of the compressible foam material is inserted into the cavity of the housing. Generally about 20-80% of the back face of the compressible foam material is inserted into the cavity of the housing, and typically about 30-60% of the back face of the compressible foam material is inserted into the cavity of the housing; however, it can be appreciated that the housing can be designed to that more than 80% of the back face of the compressible foam material can be inserted into the cavity of the housing. The compressible foam material illustrated in FIGS. 7 and 8 has a back face having a width of about 4-9 inches and a thickness of about 2-4 inches. The straight side of the compressible foam material has a length of about 4-6 inches and a thickness of about 2-4 inches. The generally straight portion of the front face of the compressible foam material has a length of about 2-5 inches and a thickness of about 2-4 inches. The radius of curvature of the curved portion of the front face of the compressible foam material is about 2.5-5 inches. The volume of the strikable surface of the compressible foam material illustrated in FIGS. 7 and 8 is about 20-140 $in^3$.

The present invention has been described with reference to a number of different embodiments. It is to be understood that the invention is not limited to the exact details of construction, operation, exact materials or embodiments shown and described, as obvious modifications and equivalents will be apparent to one skilled in the art. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

I claim:

1. A percussion instrument that comprises a housing, a compressible foam material connected to the housing and an electronic pick-up at least partially embedded within said compressible foam material, said compressible foam material having a density of at least about 1.2 $lbs/ft^3$, a compressive strength of at least about 5 psi, and a tear resistance of at least about 8 lbs/in across the grain @ 0.5 inch thickness, wherein said compressible foam material has a front face and a rear face and said electronic pick-up positioned in a pick-up slot and spaced from said front face and said rear face of said compressible foam material, said pick-up slot having a variable maximum width along a longitudinal length of said pick-up slot, a portion of said pick-up slot having a width that enables said electronic pick-up to be drawn though a pick-up slot opening in one face of said compressible foam material and into an interior region of said compressible foam material, another portion of said pick-up slot having a width that prevents said electronic pick-up from being drawn though said another portion of said pick-up slot.

2. The percussion instrument as defined in claim 1, wherein said housing includes a cavity, a portion of said compressible foam material positioned in said cavity.

3. The percussion instrument as defined in claim 2, wherein less than about 40 percent of an outer surface of said compressible foam material is positioned in said cavity.

4. The percussion instrument as defined in claim 1, wherein said compressible foam material has a front face and a rear face, and a pick-up slot extending from said front face to said rear face, said electronic pick-up having a main body, said main body of said electronic pick-up positioned in said pick-up slot and spaced from said front face and said rear face of said compressible foam material.

5. The percussion instrument as defined in claim 1, wherein a main body of said electronic pick-up including a friction material is secured to said main body.

6. The percussion instrument as defined in claim 1, including a compression plate positioned on a front face of said compressible foam material, said compression plate at least partially compressing a portion of said front face toward said rear face of said compressible foam material, said compression plate spaced from an outer edge of said front face.

7. The percussion instrument as defined in claim 1, including a stand bracket connected to a back face of said housing.

8. The percussion instrument as defined in claim 7, wherein said stand bracket is designed to connect to a second percussion instrument so as to simultaneously support two percussion instruments on a stand pole.

9. The percussion instrument as defined in claim 1, including an audio jack connected to said housing, at least a portion of said audio jack positioned in said cavity of said housing.

10. A percussion instrument that comprises a housing, a compressible foam material connected to the housing and an electronic pick-up at least partially embedded within said compressible foam material, said compressible foam material having a density of at least about 1.2 lbs/ft$^3$, a compressive strength of at least about 5 psi, and a tear resistance of at least about 8 lbs/in across the gain @ 0.5 inch thickness, said compressible foam material has a front face and a rear face, and a pick-up slot extending from said front face to said rear face, said electronic pick-up having a main body, said main body of said electronic pick-up positioned in said pick-up slot and spaced from said front face and said rear face of said compressible foam material, said pick-up slot having a variable maximum width along a longitudinal length of said pick-up slot, a front portion of said pick-up slot having a width that enables said electronic pick-up to be drawn though said pick-up slot opening in said front face of said compressible foam material and into an interior region of said compressible foam material, a rear portion of said pick-up slot having a width that prevents said electronic pick-up from being drawn though said pick-up slot.

11. A percussion instrument that comprises a housing, a compressible foam material connected to the housing, a compression plate positioned on a front face of said compressible foam material, and an electronic pick-up at least partially embedded within said compressible foam material, said compressible foam material having a density of at least about 1.2 lbs/ft$^3$, a compressive strength of at least about 5 psi, and a tear resistance of at least about 8 lbs/in across the gain @ 0.5 inch thickness, said compression plate at least partially compressing a portion of said front face toward said rear face of said compressible foam material, said compression plate spaced from an outer edge of said front face, said compressible foam material includes two plate slots, said two plate slots extending from said front face to said rear face of said compressible foam material, said two plate slots designed to each receive a plate mount arrangement, each of said plate mount arrangements designed to extend through a complete longitudinal length of said plate slot and secure said compression plate to said housing.

12. The percussion instrument as defined in claim 11, wherein said compression plate at least partially overlying an opening of said plate slots on said front face of said compressible foam material.

13. The percussion instrument as defined in claim 11, wherein at least one of said plate mount arrangements includes a tubular member and a mount element, said tubular member having an outer surface and a tube cavity through the complete longitudinal length of said tubular member, said outer surface designed to contact an inner surface of said plate slot, said mount element positioned in the full longitudinal length of said tube cavity.

14. The percussion instrument as defined in claim 11, wherein said tubular member is shorter than a longitudinal length of said plate slot and said mount element has a longitudinal length that is greater than said longitudinal length of said tubular member.

15. The percussion instrument as defined in claim 11, wherein at least a portion of said mount element that is positioned in said tube cavity has a cross-sectional area that is at least about 1% less than a cross-sectional area of said tube cavity.

16. A percussion instrument that comprises a housing, a compressible foam material connected to the housing, an electronic pick-up embedded within said compressible foam material and a compression plate, said housing including a front opening and a cavity, said compressible foam material including an outer surface, a front face, a rear face, and a rear portion that includes said rear face, said rear portion of said compressible foam material extending through said front opening of said housing and into said cavity of said housing, about 5-30 percent of the outer surface of the compressible foam material is inserted into said cavity of said housing, said electronic pick-up having a main body and an electrical connection connected to said main body, said compressible foam material including a pick-up slot extending from said front face to said rear face, said main body of said electronic pick-up positioned in said pick-up slot and spaced from said front face and said rear face of said compressible foam material, said pick-up slot having a variable maximum width along a longitudinal length of said pick-up slot, a front portion of said pick-up slot having a width that enables said electronic pick-up to be drawn though said pick-up slot opening in said front face of said compressible foam material and into an interior region of said compressible foam material, a rear portion of said pick-up slot having a width that prevents said electronic pick-up from being drawn though said pick-up slot, said electronic pick-up spaced from said outer surface of said compressible foam material, said compression plate positioned on said front face of said compressible foam material and spaced from an outer edge of said front face, said compression plate overlying said opening of said pick-up slot on said front face, said compression plate at least partially compressing a portion of said front face toward said rear face of said compressible foam material, said compressible foam material having a density of about 1.2-6 lbs/ft$^3$, a compressive strength of about 5-28 psi, and a tear resistance of at least about 8 lbs/in across the grain @ 0.5 inch thickness.

17. The percussion instrument as defined in claim 16, wherein said main body of said electronic pick-up includes a friction material secured to said main body, said friction material frictionally engaging an inner surface of said pick-up slot to inhibit or prevent longitudinal movement of said main body within said pick-up slot.

18. The percussion instrument as defined in claim 16, wherein said compressible foam material includes two plate slots, said two plate slots extending from said front face to said rear face of said compressible foam material, said two plate slots designed to each receive a plate mount arrangement, each of said plate mount arrangements designed to extend through a complete longitudinal length of said plate slot and secure said compression plate and said compressible foam material to said housing, said compression plate overlying an opening of said plate slots on said front face of said compressible foam material.

19. The percussion instrument as defined in claim 18, wherein at least one of said plate mount arrangements includes a tubular member and a mount element, said tubular member having an outer surface and a tube cavity through the complete longitudinal length of said tubular member, said outer surface designed to frictionally contact an inner surface of said plate slot, said mount element positioned in the full longitudinal length of said tube cavity, said tubular member having a longitudinal length that is shorter than said longitudinal length of said plate slot, said mount element has a longitudinal length that is greater than said longitudinal length of said tubular member, at least a portion of said mount element that is positioned in said tube cavity has a cross-sectional area that is at least about 2% less than a cross-sectional area of said tube cavity.

20. The percussion instrument as defined in claim 16, including a stand bracket and audio jack connected to said housing, said stand bracket connected to a back face of said housing, at least a portion of said audio jack positioned in said cavity of said housing.

* * * * *